United States Patent [19]

Matikainen et al.

[11] 4,103,565

[45] Aug. 1, 1978

[54] ROLL DRIVE FOR PAPER MACHINES AND THE LIKE

[75] Inventors: Martti Matikainen; Juhani Ovaska, both of Jyväskylä, Finland

[73] Assignee: Valmet Oy, Helsinki, Finland

[21] Appl. No.: 679,234

[22] Filed: Apr. 22, 1976

[30] Foreign Application Priority Data

Apr. 25, 1975 [FI] Finland ..... 751262

[51] Int. Cl.[2] ..... F16H 37/06; F16H 57/02; F16H 1/28; B21B 35/00

[52] U.S. Cl. ..... 74/665 L; 74/606 R; 74/675; 74/801; 72/249

[58] Field of Search ..... 74/665 L, 665 N, 665 P, 74/665 B, 665 A, 665 E, 674, 675, 606 R, 785, 801; 72/249

[56] References Cited

U.S. PATENT DOCUMENTS

| | | | |
|---|---|---|---|
| 3,357,225 | 12/1967 | Grube | 74/675 X |
| 3,424,035 | 1/1969 | Heidrich | 74/801 |
| 3,459,072 | 8/1969 | Shannon | 74/801 |
| 3,633,441 | 1/1972 | Hicks | 74/801 |
| 3,757,608 | 9/1973 | Willner | 74/801 |
| 3,888,138 | 6/1975 | Hiersig | 74/674 X |
| 3,897,693 | 8/1975 | Garman et al. | 74/606 R X |

FOREIGN PATENT DOCUMENTS

| | | | |
|---|---|---|---|
| 1,930,350 | 12/1970 | Fed. Rep. of Germany | 72/249 |
| 2,202,037 | 7/1973 | Fed. Rep. of Germany | 72/249 |

*Primary Examiner*—Samuel Scott
*Assistant Examiner*—Lance W. Chandler
*Attorney, Agent, or Firm*—Steinberg & Blake

[57] ABSTRACT

A roll drive for a machine of the type used in connection with the manufacture of paper. The roll which is to be driven has an end situated at a plane which is normal to the roll axis, and at the latter plane there is a supporting structure which supports the roll for rotation about its axis. Closely adjacent to this plane is a planetary gear transmission having an output and an input. The latter output is connected by way of a suitable transmission structure to the end of the roll for driving the latter with the output of the planetary gear transmission, while a rotary drive is connected to the input of the planetary gear transmission for driving the roll through the latter transmission and structure connected between the planetary gear transmission and the end of the roll.

9 Claims, 5 Drawing Figures

ROLL DRIVE FOR PAPER MACHINES AND THE LIKE

BACKGROUND OF THE INVENTION

The present invention relates to mechanical drives for transmitting a drive to a roll of a machine of the type used in connection with the manufacture of paper. Thus the drive of the present invention is particularly suitable in connection with driving a drying roll or a press roll of a paper or cellulose machine, or a roll group of such a machine. This drive of the invention includes an appropriate reduction gearing for the purpose of transmitting power to a roll which is to be driven.

Various driving mechanisms which include reduction gearing are of course well known, such mechanisms being used for driving rolls such as drying or press rolls in paper machines or in machines which provide cellulose to be subsequently used in paper machines. With such known drives it is conventional to utilize relatively long assemblies of shafts and universal joints in order to transmit the drive to a structure such as a press roll at the press section of the paper machine. This long articulated shaft type of transmission is connected with a conventional reduction gearing which includes a motor capable of driving at a relatively high speed a shaft which is connected to the motor by way of a suitable flange coupling.

Conventional drives of the above type suffer from several drawbacks. Thus, these conventional drives undesirably include relatively long and heavy intermediate shafts, situated between the reduction gearing and the machine, occupying an undesirably large amount of space on opposite sides of the machine, thus requiring an extremely large room to accommodate both machine and the structure for driving the same.

A further disadvantage of the conventional constructions of the above type resides in the fact that the extremely long shafts in the transmission are exposed to vibrations and require special protection. Because of the use of such long intermediate shafts in the conventional transmission subsequent to the reduction gearing, such shafts operate at a relatively slow speed, so that calculations are unavoidably carried out with a torque which is of an undesirably great rated value. Moreover, the supporting structure required for such conventional transmissions involve undesirably high costs.

In addition, an extremely large amount of installation work is required when setting up the conventional drive mechanisms of the above type, and the cost of such work per unit of time is much greater than the cost involved in connection with installation work which is directly related to the production of the driving mechanism.

A further drawback of the conventional driving mechanisms resides in the fact that they create an undesirably large amount of noise during operation and this noise is difficult to suppress.

SUMMARY OF THE INVENTION

It is accordingly a primary object of the present invention to provide a drive transmission structure which will avoid the above drawbacks.

In particular it is an object of the present invention to provide a transmission according to which the power can be transmitted substantially along a straight line to the machine where the roller which is to be driven is located.

A more specific object of the present invention is to provide a transmission which makes it possible to replace the previously required long and heavy intermediate shaft structure with a much lighter and shorter shaft structure.

Furthermore it is an object of the present invention to provide a shaft structure of this type which is situated in advance of the reduction gearing and which rotates at a relatively high speed, thus enabling the shaft structure to be lighter.

Furthermore it is an object of the present invention to provide a construction according to which the reduction gearing may advantageously be totally installed directly at the machine which has the roller which is to be driven, with a considerable saving of space and with a superior suppression of operating noise.

It is also an object of the present invention to provide a construction according to which the drive for the roll which is to be driven can be installed in an operating condition before the entire machine is situated in the room where it is to be set up for operation.

In connection with paper machines, it has been found possible by way of the present invention to decrease the machine room area required on both sides of a paper machine to the extent of approximately 200 square meters per paper machine, because with the present invention the intermediate shaft structure will be considerably shorter than was previously required.

According to the invention the transmission includes a planetary gear transmission capable of being carried, for example, directly by the structure which carries the bearing for the roll which is to be driven, and connected along a straight line to the roll which is to be driven so that, for example, the planetary gear transmission of the invention is substantially coaxial with the roll which is to be driven, a spider of the planetary transmission, which supports the planetary gears thereof, being connected to the end of the roll for driving the latter while the sun gear of the planetary transmission is connected with a source of power.

Thus, with the present invention a machine which has a roll which is to be rotated about its axis and which is of the type used for manufacturing paper has in a plane which is normal to the axis of the roll and situated at the end of the roll a support means which supports the roll at its end for rotation about its axis. A planetary gear transmission means is situated closely adjacent to the latter plane, is also carried by the support means which supports the end of the roll, and has an output which through a suitable connecting means is connected to the end of the roll for driving the latter, while a rotary drive is connected to the input of the planetary gear transmission means.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
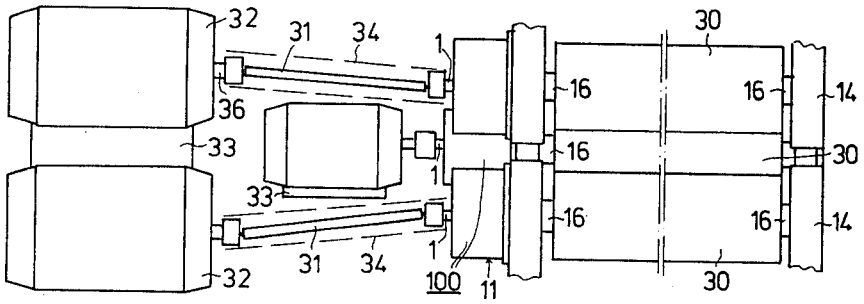
FIG. 1 is a schematic top plan view of a drive of the invention, FIG. 1 illustrating the principle of operation of the invention in connection with press rolls of a paper machine.
Figure 2:
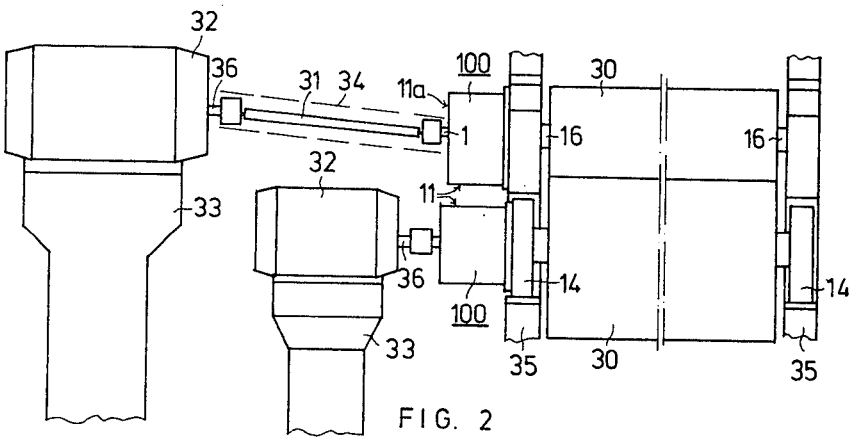
FIG. 2 is a front elevation of the structure shown in FIG. 1, with some of the components being fragmentarily illustrated.

The use and principle of operation of the apparatus according to the present invention is illustrated in FIGS. 1 and 2. This structure of FIGS. 1 and 2 includes a rotary drive means part of which is formed by the illustrated driving motors 32 which can be suitable electric motors connected in any suitable way to a source of electrical energy. The motors 32 respectively have output shafts 36 which through suitable universal joints are connected with transmission shafts 31 which rotate at a relatively high speed. These shafts 31 can be protected by suitable tubular casings 34, as schematically shown in FIGS. 1 and 2. Distant from the motor shafts 36, the transmission shafts 31 are connected, also through suitable universal joints where required, with shafts which thus also rotate at a high speed. These shafts 1 are situated directly at the input portions of planetary gear transmissions 100. These transmissions 100 respectively form a plurality of planetary gear transmission means which are installed in accordance with the invention. In the illustrated example the several planetary gear transmission means 100 serve to transmit a drive to press rolls 30 situated in the press section of a paper machine. Each press roll 30 has a pair of opposed ends 16 supported for rotation by a support means 14. It will be seen that each end 16 of a roll 30 is situated in a plane which is normal to the roll axis and in which the support means 14 is situated. In the example illustrated in FIGS. 1 and 2 it will be seen that the planetary gear transmissions 100 each includes a casing 11 which is fixed to and forms part of the support means 14. The supporting brackets 14 are carried by suitable base structures or seats 35, while the driving motors 32 are carried by suitable base structures or seats 33.

Figure 3:
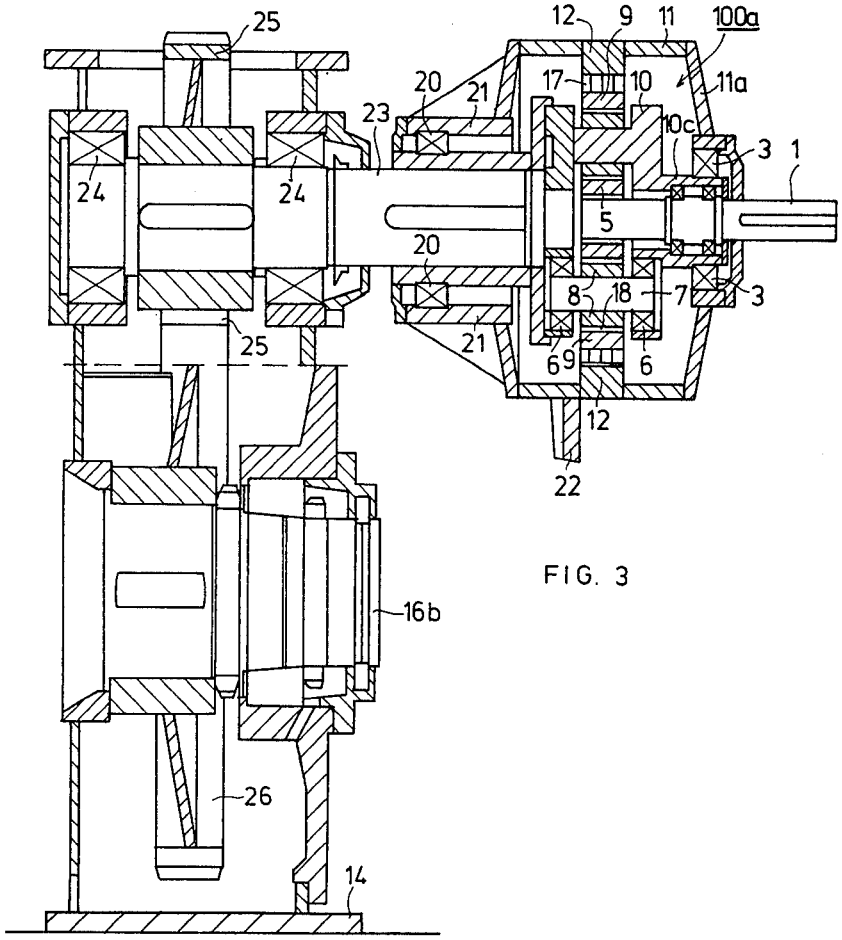
FIG. 3 is a partly schematic sectional elevation of one specific embodiment of the invention taken in a plane which contains the axis of a roll which is to be driven, the particular embodiment of FIG. 3 being suitable for operation of the dry-end roll group of a paper machine.
Figure 5:
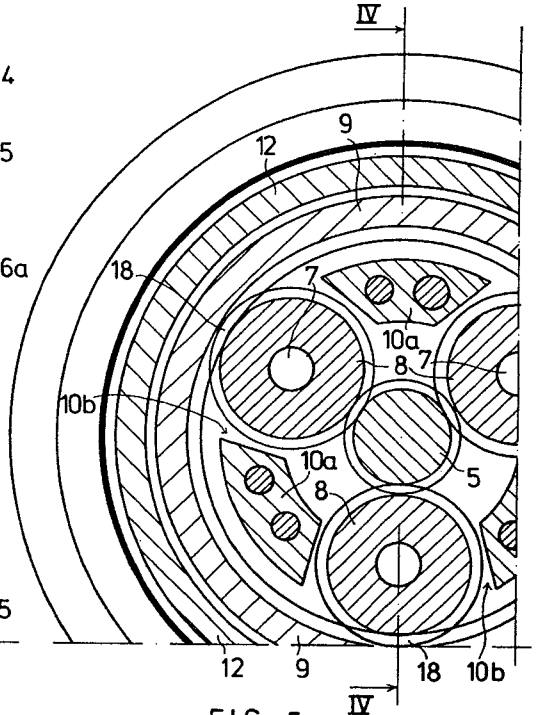
FIG. 5 is a transverse section of the structure of FIG. 4 taken along line V—V of FIG. 4 in the direction of the arrows and showing the particular details of the planetary gear transmission.
Figure 4:
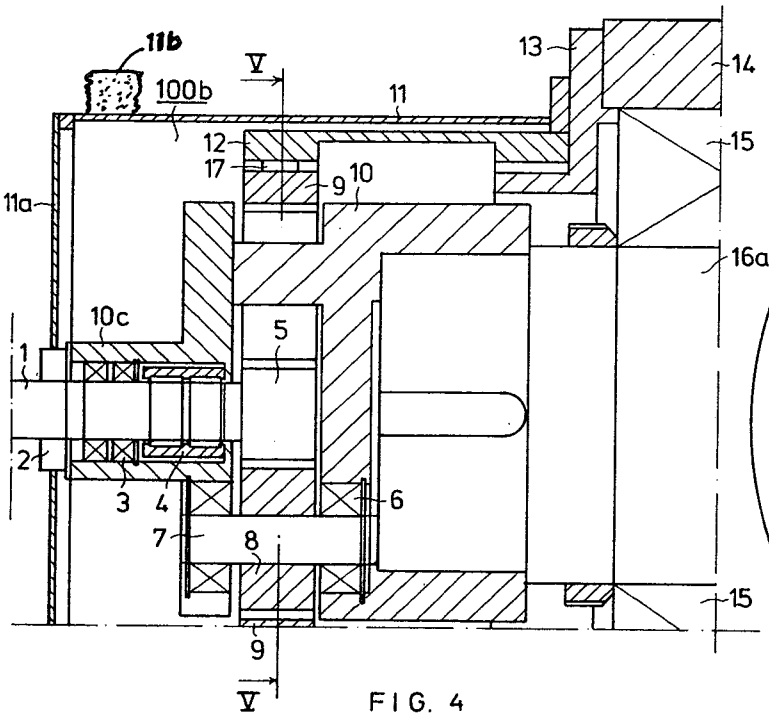
FIG. 4 is a fragmentary sectional elevation of another embodiment of the invention utilized in the illustrated example for driving a press roll at the press section of a paper machine, with the section of FIG. 4 containing the axis of the roll which is to be driven and taken along line IV—IV of FIG. 5 in the direction of the arrows.

The particular embodiment of the invention which is schematically illustrated in FIG. 2 is shown in detail in connection with one of the transmissions in FIGS. 4 and 5, while the details of another embodiment are illustrated in FIG. 3.

Referring to FIGS. 4 and 5 which illustrate the planetary gear transmission structure in connection with the drive to one of the rolls 30, it will be seen that the shaft 1 driven from the shaft 31 in the manner described above transmits a drive to the planetary gear transmission means **100*b* which is illustrated in FIGS. 4 and 5. At its output end the shaft 1 is supported for rotation by bearings 3 situated within an elongated sleeve 10*c* which forms part of a spider means 10 of the planetary gear transmission means. The illustrated casing 11 has a wall 11*a* formed with an opening through which the shaft 1 extends with a suitable packing 2 being situated in this opening of the wall 11*a* of the casing 11 and surrounding an engaging shaft 1**.

Within the sleeve **10*c* at the region of a left wall of the spider means 10, as viewed in FIG. 4, the shaft 1 is connected with a shaft fixed to the sun gear 5 of the planetary gear transmission means, the connection of the shaft 1 to the shaft of the sun gear 5 being provided in a bushing 4 in which geared portions at the adjoining ends of the shaft 1 and the shaft of the sun gear 5 are located. Thus, for example, the right end of the shaft 1 and the left end of the shaft fixed to the sun gear 5, as viewed in FIG. 4, fixedly carry gears which mesh with axially extending teeth formed at the interior of the sleeve or bushing 4. Thus a connection in the nature of a splined connection is provided between the shaft 1 and the shaft fixed to the sun gear 5, the sleeve 4 having inner spline teeth which mesh with outer spline teeth at the adjoining ends of the shaft 1 and the shaft which is fixed to the sun gear 5. This sun gear 5 forms the input of the planetary gear transmission means 100*b***.

The sun gear 5 meshes with planetary gear 8 which are respectively fixed to shafts 7 which in turn are supported at their opposed ends for rotary movement by way of bearings 6 which are respectively carried by the opposed walls of the spider means 10, the planetary gears 8 being situated between these opposed walls in the manner illustrated in FIG. 4.

The planetary gears 8 are surrounded by and mesh with the internal teeth of a ring gear 9 of the planetary gear transmission means **100*b*. This ring gear 9 is carried by a portion 12 of the support means which includes the structure 14, in a manner described in greater detail below, the gear 9 normally remaining stationary. Thus, the input of the planetary gear transmission means 100*b* is formed by the sun gear 5 while the output thereof is formed by the spider means 10. As is apparent from FIG. 4, the right or inner portion of the spider means 10 illustrated in FIG. 4 surrounds and is directly keyed to the portion 16*a* of the end 16 of one of the rolls 30 which is shown in FIGS. 1 and 2. Thus, the output formed by the spider means 10 of the planetary gear transmission means 100*b* is connected directly with the end of the roll which is to be driven, and this end has its portion 16*a* supported for rotary movement by way of a bearing means 15 which forms part of the support means which includes a structure 14. It will be seen that this bearing means 15 serves not only to support one end of the roll which is to be driven but also through this end the bearing means 15 also serves to support part of the planetary gear transmission means itself, this part being the output of the planetary gear transmission means which is formed by the spider means 10**.

The opposed walls of the spider means 10, between which the planetary gears 8 are located, are interconnected with each other by way of bodies **10*a* (FIG. 5) which are fixed to and extend between these opposed walls of the spider means 10 and which are circumferentially situated between the planetary gears 8 so as to define radial channels or spaces 10*b* in which the planetary gears 8 are situated in the manner illustrated in FIG. 5. FIG. 5 also shows the inner teeth 18 of the ring gear 9 with which the planetary gears 8 are in mesh, these planetary gears 8 of course also being in mesh with the teeth of the sun gear 5 as illustrated in FIG. 5. As is apparent from FIG. 4, the outer sleeve 10*c* into which the shaft 1 extends and into which the shaft fixed to the sun gear 5 extends is integrally fixed with and extends from one of the transverse walls of the spider means between which the planetary gears are located. The portion 12 of the support means, which serves to support the ring gear 9 in the manner described in greater detail below, is rigidly fixed with a ring 13 which in turn is rigidly fixed with the bracket 14 of the support means which carries the bearing 15, so that the parts 12–14 all form part of a common support means both for the roll which is to be driven as well as for the planetary gear transmission means. This support means also includes the casing 11 in which the planetary gear transmission is housed as illustrated. In the illustrated example the ring 12 has at its inner periphery inwardly directed radially extending teeth between which outwardly directed radially extending teeth of the gear 9 are situated, forming in this way a geared connection 17 between the components 9 and 12. While the ring 9 cannot rotate, nevertheless because of this geared connection 17 the ring 9 is capable of moving freely in the plane which contains section line V—V of FIG. 4 and in which the sun gear and planetary gears are located as well as the outer ring gear 9. This limited free movement of the ring 9 in this plane enables the planetary gear transmission means to adjust itself automatically with respect to the axis of the roll which is to be driven and with respect to part 12** of the supporting structure so that in this way it is possible automatically to compensate for any inaccuracies in the dimensions of the structure so that the structure will automatically be properly mounted.

While the casing 11 of the support means will of course protect the planetary gear transmission means and will to some extent act to suppress noise, this latter effect can be enhanced by covering the casing 11 with a noise-suppressing material **11*b*, as schematically shown fragmentarily in FIG. 4. This noise-suppressing material 11*b* may be in the form of a suitable porous layer capable of absorbing noise and covering the exterior of the casing 11**. Thus, the situation of the planetary gearing into a casing with the possibility of considerably suppressing the driving mechanism noise will greatly contribute to the comfort of individuals situated in the region of the machine.

It is apparent that particularly by way of the connection structure 17 between the components 9 and 12 it is possible for the planetary gear transmission means, the shaft 1, and the axis of the roll 30 which is to be driven all to be located along a common straight line with the planetary gear transmission means in fact forming part of the machine itself and being capable of being assembled with the machine before the entire machine is even installed in the room where it is to operate. Instead of providing for automatic compensation of manufacturing inaccuracies by way of a geared connection 17 as described above, it is possible to provide other structures for the same purpose. For example it is possible to situate between elements 12 and 9 suitable springs which will support the element 9 while permitting the latter to automatically adapt itself so as to be precisely coaxial with the roll 30. Thus a suitable gear bushing and spring assembly can be used for this purpose.

The above-described structure of FIGS. 4 and 5 is highly suitable for use with driving mechanisms particularly of the type encountered in paper machines at the drying and press rolls thereof. However, it is also possible in some cases to utilize the invention in an arrangement as illustrated in FIG. 3.

Referring now to FIG. 3, it will be seen that this embodiment includes a planetary gear transmission means **100*a* which is identical with the planetary gear transmission means 100*b*. In this embodiment, however, the output formed by the spider means 10 of the planetary gear transmission means is connected to the end 16*b* of the roll which is to be driven by way of a connecting means in the form of a gear transmission shown in FIG. 3 and described below, whereas this connecting means in the embodiment of FIGS. 4 and 5 is formed by the right end of the spider means 10, as viewed in FIG. 4, this right end surrounding and being directly keyed to the portion 16*a* of the end 16 of the roll 30 as described above. Thus, the connecting means in FIG. 3 includes a gear 26 which is fixed directly to and surrounds the end 16*b* of the roll which is to be driven, this end 16*b* being supported by a simple bearing structure carried also by the bracket 14 of the support means. This support means in the embodiment of FIG. 3 also includes a frame wall 22 which directly carries the casing 11 in which the planetary gear transmission means is housed and which also forms part of the support means. It will be seen that the ring 12 of the embodiment of FIG. 3 forms part of the casing means 11. The roll which is driven in the embodiment of FIG. 3 may be a drying roll or drying cylinder at the drying section of a paper machine, this cylinder including the shaft 16*b* which is shown as being keyed to the gear 26. This gear 26 meshes with a gear 25 of the connecting means of the embodiment of FIG. 3. The gear 25 is in turn keyed directly to a shaft 23 which is also keyed directly to the inner wall of the spider means 10, this inner wall of the spider means 10, shown to the left of the planetary gears 8 in FIG. 3, having a sleeve which surrounds and into which the shaft 23 extends to be keyed to this sleeve which forms a fixed extension of the spider means 10 in a manner illustrated in FIG. 3**.

The gear 26 meshes, for example, with another similar gear which drives another drying cylinder following the drying cylinder which has the end **16*b* shown in FIG. 3, so that in this way the transmission of FIG. 3 may be used to drive a plurality of rolls. Thus the entire group of drying cylinders may be driven from the shaft 23 with the embodiment of FIG. 3. The rotary drive means which is connected with the shaft 1 thus can operate through the single planetary gear transmission means 100*a* of FIG. 3** to drive an entire group of rolls.

In the example of FIG. 3 the sleeve of the spider means 10 which is keyed to the shaft 23 is itself supported for rotary movement by way of the bearing 20 carried by a sleeve portion 21 of the casing 11 of FIG. 3. The shaft 23 is in turn supported for rotary movement by bearings 24 carried by the support means in the manner illustrated in FIG. 3, and it will be seen that the right bearing 24 of FIG. 3 serves through the right portion of the shaft 23 to support part of the planetary gear transmission means **100*a*. The bearings 24 of course form part of the supporting structure 14 for the drying cylinders. As was pointed out above, the gear 25 which meshes with the gear 26 is greatly keyed to the shaft 23** so as to rotate therewith.

It will be seen that with the above-described embodiments of the invention there is no power transmission to the casing of the gearing, as a result of the symmetrical construction described above, and this feature also is one of the advantages of the planetary gearing which has been profitably utilized with the invention as described above.

Of course, the invention is not restricted to details of the above-described embodiments, inasmuch as many of these details can be varied within the limits of the claims which follow.

What is claimed is:

1. In a machine which has a roll which is to be rotated about its axis, such as a machine of the type used in connection with the manufacture of paper, said roll having an end situated at a plane which is normal to said roll axis, and support means situated at said plane for supporting said roll at said end thereof for rotation about said axis, planetary gear transmission means situated adjacent to said plane and having an output and an input, connecting means connecting said output of said planetary gear transmission means to said end of said roll for transmitting a drive from said planetary gear transmission means to said roll, and rotary drive means operatively connected with said input of said planetary gear transmission means for driving said roll through said planetary gear transmission means and said connecting means, said planetary gear transmission means including an outer ring gear having inner and outer teeth, an inner sun gear, and a rotary spider means carrying a plurality of planetary gears which extend between and mesh with said inner sun gear and said inner teeth of said outer ring gear, said rotary spider means forming said output of planetary gear transmission mean while said sun gear forms said input thereof, and said support means including an outer stationary ring surrounding said outer ring gear and having inner teeth with which said outer teeth of said outer ring gear mesh, thus providing between said outer stationary ring and said outer ring gear and geared connection supporting said outer ring gear for substantially free movement in a plane containing said outer ring gear, planetary gears, and sun gear, said free movement of said outer ring gear being a non-rotary movement for the purpose of compensating for any inaccuracies which otherwise might be present in the mounting of said planetary gear transmission on said support means, said spider means having a pair of walls between which said planetary gears are located and including bodies extending between and fixed to said walls and situated circumferentially between said planetary gears.

2. The combination of claim 1 and wherein said rotary drive means which is operatively connected to said sun gear includes a motor and a transmission shaft extending between said motor and sun gear, said motor, said transmission shaft, said sun gear, and said end of said roll all being located substantially at the same elevation and substantially along a straight line.

3. The combination of claim 1 and wherein a casing means encloses said planetary gear transmission means and forms part of said support means.

4. The combination of claim 3 and wherein said casing means carries a noise-suppressing material.

5. The combination of claim 1 and wherein said support means includes a bearing means supporting both said end of said roll and a part of said planetary gear transmission means.

6. The combination of claim 1 and wherein said support means includes a bearing means supporting both a part of said connecting means and a part of said planetary gear transmission means.

7. The combination of claim 1 and wherein said spider means has a portion directly connected with said end of said roll.

8. In a machine which has a roll which is to be rotated about its axis, such as a machine of the type used in connection with the manufacture of paper, said roll having an end situated at a plane which is normal to said roll axis, and support means situated at said plane for supporting said roll at said end thereof for rotation about said axis, planetary gear transmission means situated adjacent to said plane and having an output and an input, connecting means connecting said output of said planetary gear transmission means to said end of said roll for transmitting a drive from said planetary gear transmission means to said roll, and rotary drive means operatively connected with said input of said planetary gear transmission means for driving said roll through said planetary gear transmission means and said connecting means, said planetary gear transmission means including an outer ring gear having inner and outer teeth, an inner sun gear, and a rotary spider means carrying a plurality of planetary gears which extend between and mesh with said inner sun gear and said inner teeth of said outer ring gear, said rotary spider means forming said output of said planetary gear transmission means while said sun gear forms said input thereof, and said support means including an outer stationary ring surrounding said outer ring gear and having inner teeth with which said outer teeth of said outer ring gear mesh, thus providing between said outer stationary ring and said outer ring gear a geared connection supporting said outer ring gear for substantially free movement in a plane containing said outer ring gear, planetary gears, and sun gear, said free movement of said outer ring gear being a non-rotary movement for the purpose of compensating for any inaccuracies which otherwise might be present in the mounting of said planetary gear transmission on said support means, said spider means having an inner portion surrounding and directly connected with said end of said roll and an outer portion in the form of a sleeve, and a shaft connected to said sun gear and extending coaxially through the latter sleeve.

9. In a machine which has a roll which is to be rotated about its axis, such as a machine of the type used in connection with the manufacture of paper, said roll having an end situated at a plane which is normal to said roll axis, and support means situated at said plane for supporting said roll at said end thereof for rotation about said axis, planetary gear transmission means situated adjacent to said plane and having an output and an input, connecting means connecting said output of said planetary gear transmission means to said end of said roll for transmitting a drive from said planetary gear transmission means to said roll, and rotary drive means operatively connected with said input of said planetary gear transmission means for driving said roll through said planetary gear transmission means and said connecting means, said planetary gear transmission means including an outer ring gear having inner and outer teeth, an inner sun gear, and a rotary spider means carrying a plurality of planetary gears which extend between and mesh with said inner sun gear and said inner teeth of said outer ring gear, said rotary spider means forming said output of said planetary gear transmission means while said sun gear forms said input thereof, and said support means including an outer stationary ring surrouding said outer ring gear and having inner teeth with which said outer teeth of said outer ring gear mesh, thus providing between said outer stationary ring and said outer ring gear a geared connection supporting said outer ring gear for substantially free movement in a plane containing said outer ring gear, planetary gears, and sun gear, said free movement of said outer ring gear being a non-rotary movement for the purpose of compensating for any inaccuracies which otherwise might be present in the mounting of said planetary gear transmission on said support means, said connecting means including a gear transmission driven by said planetary gear transmission means and extending between and operatively connected with said planetary gear transmission means and said end of said roll.

* * * * *